US007267189B2

(12) United States Patent
Willim

(10) Patent No.: US 7,267,189 B2
(45) Date of Patent: Sep. 11, 2007

(54) CRAWLER TRACK

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 11/157,378

(22) Filed: Jun. 21, 2005

(65) Prior Publication Data

US 2006/0021804 A1 Feb. 2, 2006

(30) Foreign Application Priority Data

Jun. 21, 2004 (DE) ..... 20 2004 009 758 U

(51) Int. Cl.
*B62D 55/00* (2006.01)
*B62D 55/08* (2006.01)

(52) U.S. Cl. ..... 180/9.1; 305/116; 305/185; 305/193

(58) Field of Classification Search ..... 180/9.1; 305/116, 185, 193
See application file for complete search history.

(56) References Cited

U.S. PATENT DOCUMENTS 5,096,270 A * 3/1992 Oilund et al. ..... 305/129
5,104,205 A * 4/1992 Motomura et al. ..... 305/109

FOREIGN PATENT DOCUMENTS

DE 1209455 1/1966
DE 29623183 12/1997

* cited by examiner

*Primary Examiner*—Lesley D. Morris
*Assistant Examiner*—Marlon Arce-Diaz
(74) *Attorney, Agent, or Firm*—Dilworth & Barrese LLP

(57) ABSTRACT

The invention relates to an undercarriage, preferably for a crawler-mounted crane, comprising a crawler track which runs on a crawler carrier and which consists of base plates articulatedly connected to one another, with cams being formed on the base plates which laterally center the crawler track under the rollers, wherein two metal guide sheets which extend substantially over the length of the crawler carrier and which are engaged behind by holding plates arranged at the base plates of the crawler tracks are laterally arranged at the lower carriage of the crawler carrier.

21 Claims, 3 Drawing Sheets a)

16
12
22
20
18
16
14
12
16
10
24
22
16
18
22 b)

12
20
16
18
22
14
12
16
10
24

36
38
36
34
36
34
32
16

40
38
36
36
34
16

CRAWLER TRACK

BACKGROUND OF THE INVENTION

The invention relates to an undercarriage, preferably for a crawler-mounted crane, comprising a crawler track which runs on a crawler carrier and which consists of base plates articulatedly connected to one another, with cams being formed on the base plates which engage into grooves of rollers arranged in the crawler carrier, with them laterally centering the crawler track under the rollers.

A crawler track in accordance with the prior art is shown, for example, in FIG. 1. Part of an undercarriage 10 is shown there which comprises a crawler carrier 12 on which a crawler track 14 runs which consists of base plates 16 articulately connected to one another. It can in particular be clearly seen from the sectional representation in accordance with FIG. 1*a* that the base plates 16 have cams 18 approximately centrally. The cams engage into grooves 20 which are provided around the periphery in rollers 22 (cf. FIG. 1*a*). The rollers are arranged in the crawler carrier 12. The crawler track 14 is driven by a drive wheel 24 in a conventional manner.

In the previously described constructional embodiment, the problem in particular exists with the crawler-mounted crane that the track is very heavy due to the high forces and consequently sags very pronouncedly with the slightest ground irregularities, as is indicated in FIG. 1. In this case, the lateral guidance of the crawler track 14 by the cams 18 of the base plate 16 is no longer ensured. The cams 18 can, however, not be made higher since then the diameters of the rollers 22 would have to be made larger in order to be able to accommodate the higher cam in the corresponding groove 20 running around the periphery. This is, however, not possible since then it is not possible to provide enough rollers 22 in the undercarriage 10 and thus the load on the individual base plate 16 increases in a non-permitted manner.

If a longitudinal movement is made with a sagging crawler track 14, as is shown in FIG. 1, the lower track carriage contacts the ground and the crawler carrier pivots over the track. The cams 18 are then no longer located beneath the ring-shaped cut-out 20 of the rollers 22. On a further forward movement of the crawler undercarriage, the rollers 22 are thereby pushed toward the tips of the cams 18. Due to the high weight of the crane, this results in severe damage to the cams 18 on the base plates 16. If the crane operator does not notice this damage, the crawler track 14 can jump off the crawler carrier 12. The repair of damage of this type results in a large effort of time and equipment.

SUMMARY OF THE INVENTION

It is the object of the present invention to further develop a generic undercarriage such that a jumping off of the crawler track can also be effectively prevented when ground irregularities are traveled over.

The object is solved in accordance with the invention, starting from an undercarriage and by the combination with the features herein.

Accordingly, two metal guide plates are arranged laterally at the bottom boom of the crawler carrier which extend substantially over the length of the crawler carrier and which are engaged behind by holding plates arranged on the base plates of the crawler tracks. It is hereby achieved in a simple manner that the crawler tracks cannot jump off the crawler track carrier even on rough terrain, since the cams of the base plates of the crawler track are permanently in engagement with the grooves running round the periphery of the rollers.

Preferred aspects of the invention result from the description herein.

Screws bent at right angles can advantageously be inserted into and held in holes molded at the upper side of the base plates which fix the holding plate at the base plate. In this embodiment, the holes which are molded at the upper side of the base plates and which are required for the holding of the cores during the molding process are utilized for the mounting of holding plates. Two screws bent at right angles are preferably connected to one another via a transverse web via which the screws introduced into the base plates are supported on it. The holding plates which can be placed onto these screws can, for example, be fixedly connected to the base plate via two nut bolts. To have sufficiently high strength, the holding plates can, for example, be made as castings. The holding plates can advantageously be trapezoidal and they can lead off contamination outwardly due to this shape. In accordance with the invention, the invention also relates to a crawler track for an undercarriage and to a crawler-mounted crane with an undercarriage in accordance with the invention.

A further advantage of the invention consists of the track no longer sagging during transport. The center piece can thus be jacked up substantially lower during its bolting.

Finally, the loading of a crawler-mounted crane with the undercarriage in accordance with the invention onto a low loader can be substantially improved. It was previously necessary to fix the lower track carriage of the crawler track with chains expressly provided for this purpose. This additional laying of chains around the lower track carriage can be omitted on loading in future.

BRIEF DESCRIPTION OF THE DRAWINGS

Further features, details and advantages of the invention will be explained in more detail with reference to an embodiment shown in the drawing. There are shown:

(FIG. 1*a* is a section through it);

(FIG. 2*a* is a cross-section);

DESCRIPTION OF THE PREFERRED EMBODIMENTS

Figure 2:
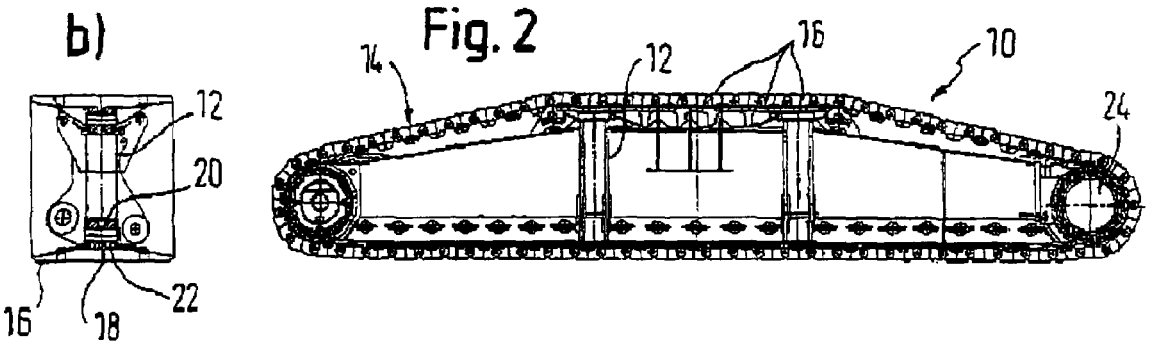
FIG. 2: a lateral representation of an undercarriage in accordance with the invention over a crawler-mounted crane

An undercarriage 10 of a crawler-mounted crane in accordance with the present invention not shown in any more detail is illustrated in FIG. 2. FIG. 2*a* shows a corresponding section, with the features material to the invention being shown in more detail in an enlarged representation of a detail of FIG. 2*a* in FIG. 6. The undercarriage 10 has a crawler carrier 12 with a crawler track 14 running on it. The crawler track consists of base plates 16 articulately connected to one another. Cams 18 are formed on the base plates 16 and are provided in peripheral grooves 20 of rollers arranged in the crawler carrier 12. The crawler track is driven, for example, by a drive wheel 24 in a manner known per se.

Figure 1:
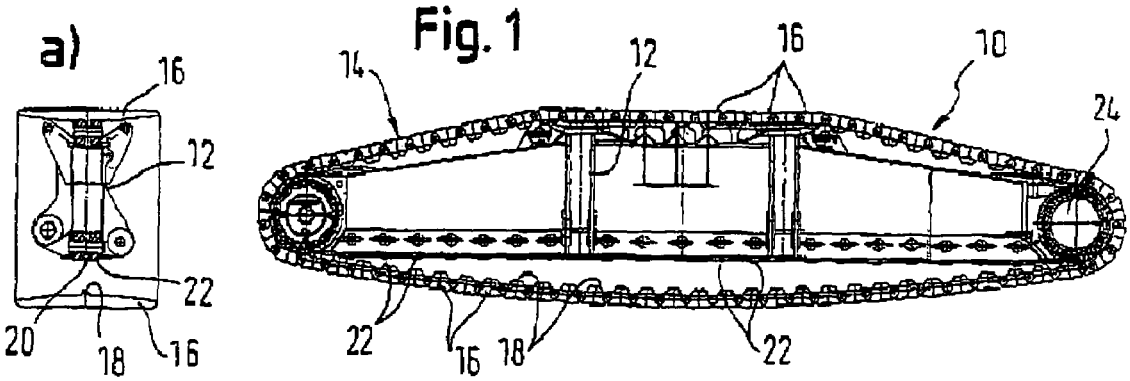
FIG. 1: a lateral representation of an undercarriage of a crawler-mounted crane in accordance with the prior art
Figure 6:
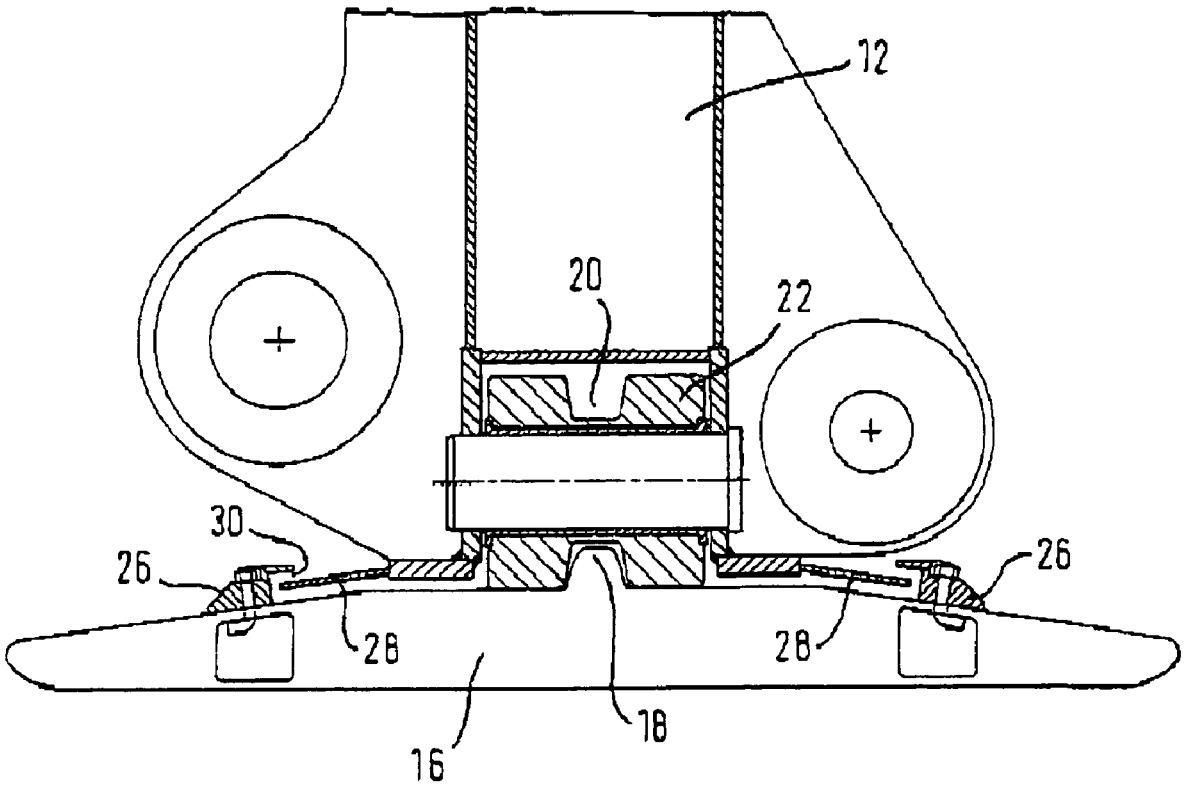
FIG. 6: a detail representation of a section through a base plate and a part of the track carrier.

A detail now results from FIG. 6 that holding plates 26 are provided laterally at the base plate 16 which engage behind or over metal guide sheets 28 fixed to the carrier. In the usual moving of the undercarriage, a gap 30 results between the holding plates 26 and the metal guide sheets 28. If, however, the risk exists that the lower track carriage of the crawler track 14 could sag, for example, when driving over an irregularity of the ground due to its own high weight, the holding plates 26 are supported on the metal guide sheets 28 and thus prevent the track carriage from sagging down in a manner such as is shown with reference to FIG. 1. The gap 30 is selected to be so small that it is lower than the height of the cams 18. It is thus reliably prevented that the cams 18 no longer lie in the groove 20.

Figure 3:
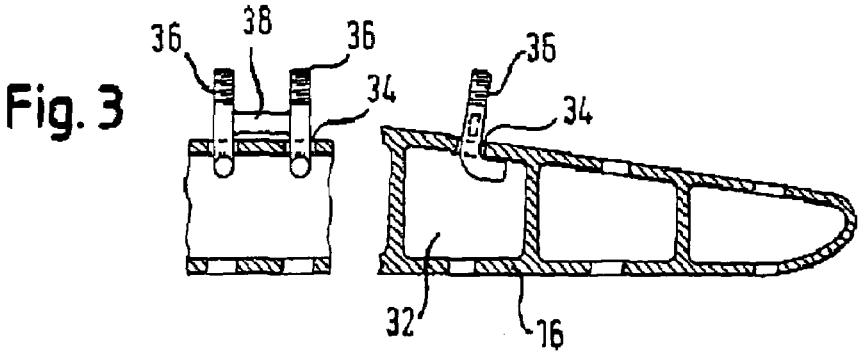
FIG. 3: a longitudinal section or transverse section through a base plate of a crawler track.
Figure 4:
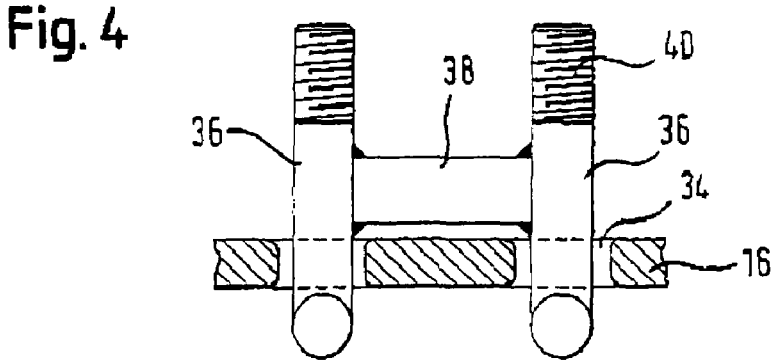
FIG. 4: an enlarged representation of a part of FIG. 3.
Figure 5:
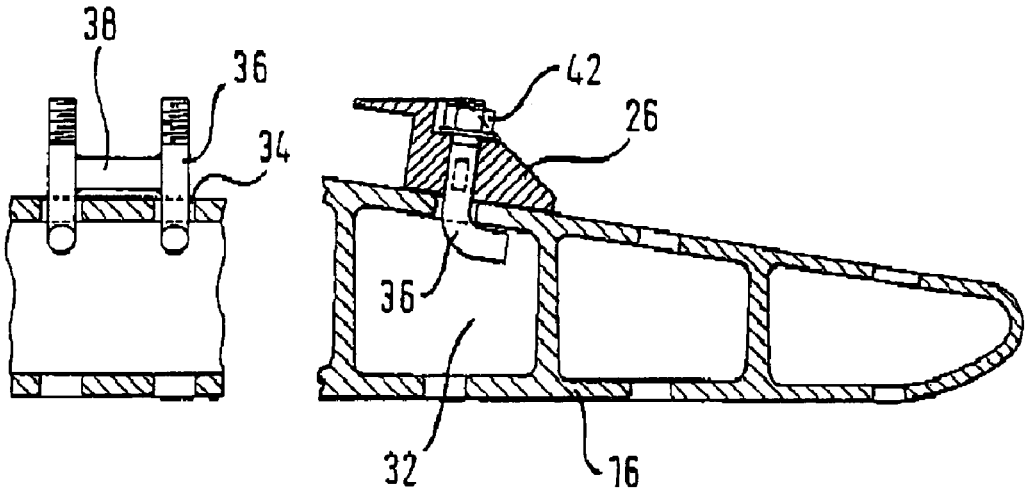
FIG. 5: corresponds to that in accordance with FIG. 3, with a holding plate additionally being screwed on here.
Figure 7:
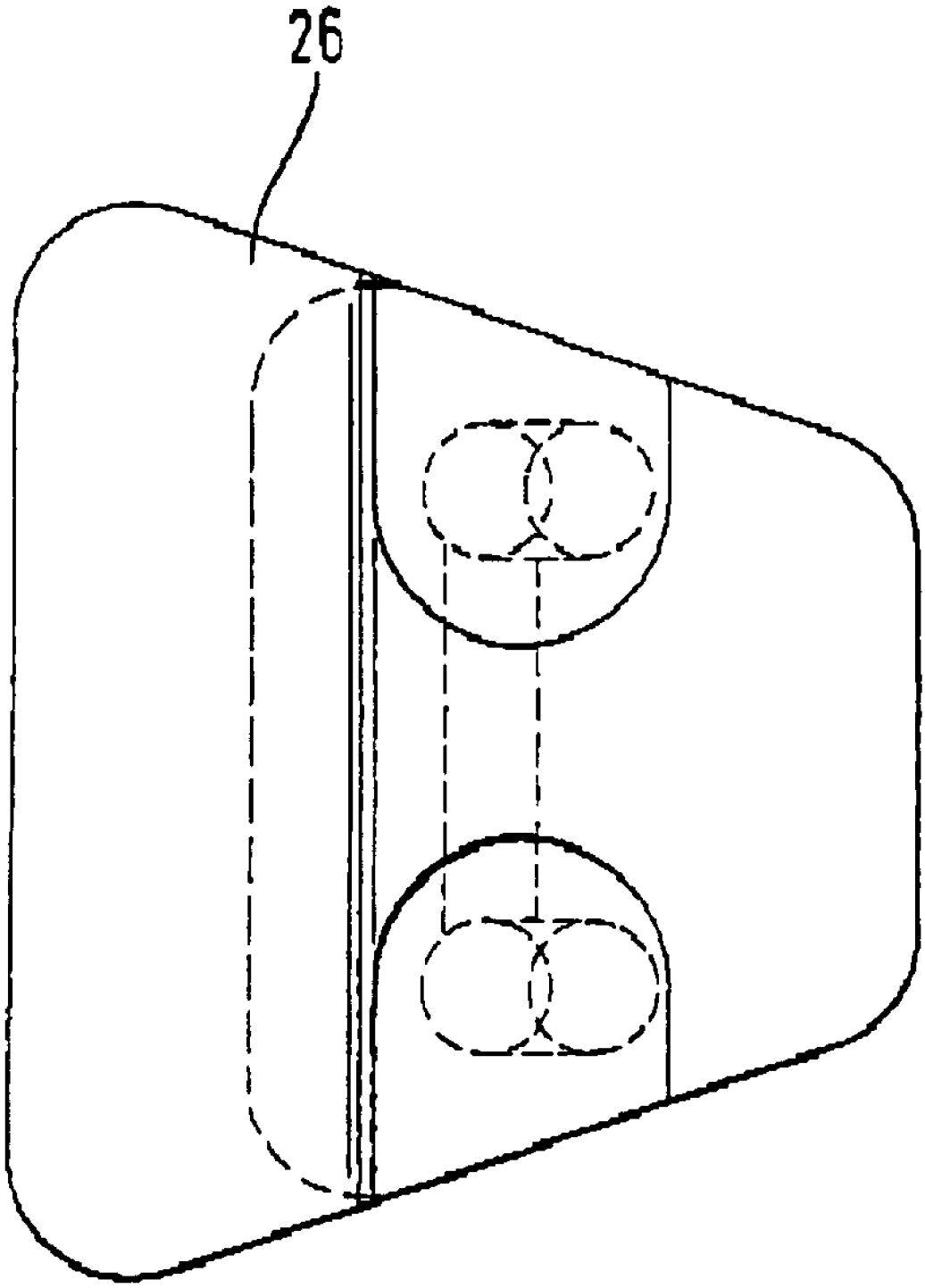
FIG. 7: a plan view of a holding plate.

The manner in which the holding plates 26 are connected to the base plates 16 results in detail from FIGS. 3, 4 and 5. It can in particular be seen from FIGS. 3 and 5 that the base plates 16 have molded holes 32. Two screws 36 bent at right angles and arranged parallel to one another engage into the molded holes via openings 34, with the screws 36 being connected to one another via a holding web 38. As results from FIGS. 3 and 5, the ends of the screws 36 bent at right angles, on the one hand, and the holding plate 38, on the other hand, are supported on the corresponding wall of the base plate 16 so that sufficient stability is given here. The screws 36 bent at right angles each have a thread 40 at their free ends (cf. FIG. 4). The holding plate 26 consisting of a cast part is placed onto the corresponding screws 36. The shape of the holding plate in particular results from the sectional representation in accordance with FIG. 5 and from the plan view in accordance with FIG. 7. As shown in detail in FIG. 5, the holding plate is secured, after corresponding placing onto the screws 36, by screw nuts 42 screwed onto the thread 40 of the screws 36. The holding plates 26, as shown in FIG. 7, preferably have a trapezoidal shape so that contamination occurring in this region is led off outwardly.

The invention claimed is:

1. An undercarriage, preferably for a crawler-mounted crane, comprising a crawler track (14) which runs on a crawler carrier (12) and includes base plates (16) articulately connected to one another, with cams (18) being formed on the base plates (16) which laterally center the crawler track (14) under rollers (22), holding plates (26) mounted upon the base plates (16) of the crawler tracks (14), and two metal guide sheets (28) arranged to extend substantially over the length of the crawler carrier (12), and engage said holding plates (26), being laterally mounted upon a lower carriage of the crawler carrier (12) to extend therefrom and into a gap (30) defined by the respective holding plates (26) between the base plates (16) and holding plates (26).

2. An undercarriage, preferably for a crawler-mounted crane, comprising a crawler track which runs on a crawler carrier and which has base plates articulately connected to one another, with cams being formed on the base plates which laterally center the crawler track under the rollers, wherein two metal guide sheets which extend substantially over the length of the crawler carrier and which are engaged behind by holding plates arranged at the base plates of the crawler tracks are laterally arranged at the lower carriage of the crawler carrier, and screws bent at right angles are inserted into and held in holes molded at the upper side of the base plates and fix the holding plates on the base plate.

3. An undercarriage in accordance with claim 2, wherein two screws bent at right angles are connected to one another via a transverse web, which screws inserted into the base plates are supported on it.

4. An undercarriage in accordance with claim 1, wherein the holding plates are made as cast parts.

5. An undercarriage in accordance with claim 1, wherein the holding plates are made in trapezoidal form.

6. A crawler track for an undercarriage in accordance with claim 1.

7. A crawler-mounted crane having an undercarriage in accordance with claim 1.

8. An undercarriage in accordance with claim 3, wherein the holding plates are made as cast parts.

9. An undercarriage in accordance with claim 2, wherein the holding plates are made as cast parts.

10. An undercarriage in accordance with claim 9, wherein the holding plates are made in trapezoidal form.

11. An undercarriage in accordance with claim 2, wherein the holding plates are made in trapezoidal form.

12. An undercarriage in accordance with claim 3, wherein the holding plates are made in trapezoidal form.

13. An undercarriage in accordance with claim 4, wherein the holding plates are made in trapezoidal form.

14. An undercarriage in accordance with claim 8, wherein the holding plates are made in trapezoidal form.

15. An undercarriage in accordance with claim 1, comprising two said holding plates (26) latterally mounted upon a respective base plate (16), each said holding plate (26) arranged to receive a respective metal guide sheet (28) protruding into the respective gap (30) defined between the holding plate (26) and base plate (16).

16. An undercarriage in accordance with claim 15, wherein said respective gaps (30) are lower than height of the cams (18) on the base plates (16).

17. An undercarriage in accordance with claim 1, wherein said gap (30) is lower than height of the cams (18) on the base plates (16).

18. An undercarriage in accordance with claim 17, wherein said gap (30) is defined between said holding plates (26) and base plates (16) in a vertical direction.

19. An undercarriage in accordance with claim 1, wherein said gap (30) is defined between said holding plates (26) and base plates (16) in a vertical direction.

20. An undercarriage in accordance with claim 15, wherein said gaps (30) are defined between said holding plates (26) and base plates (16) in a vertical direction.

21. An undercarriage in accordance with claim 16, wherein said gaps (30) are defined between said holding plates (26) and base plates (16) in a vertical direction.

* * * * *